US010654280B2

(12) United States Patent
Cowger et al.

(10) Patent No.: US 10,654,280 B2
(45) Date of Patent: May 19, 2020

(54) PRINTHEAD ASSEMBLY

(71) Applicant: Hewlett-Packard Development Company, L.P., Houston, TX (US)

(72) Inventors: Bruce Cowger, Corvallis, OR (US); Matthew J Janssen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/763,856

(22) PCT Filed: Dec. 11, 2015

(86) PCT No.: PCT/US2015/065355

§ 371 (c)(1),
(2) Date: Mar. 28, 2018

(87) PCT Pub. No.: WO2017/099809

PCT Pub. Date: Jun. 15, 2017

(65) Prior Publication Data

US 2018/0264835 A1 Sep. 20, 2018

(51) Int. Cl.
*B41J 2/175* (2006.01)

(52) U.S. Cl.
CPC ..... *B41J 2/17566* (2013.01); *B41J 2/175* (2013.01); *B41J 2/17513* (2013.01);
(Continued)

(58) Field of Classification Search
CPC .... B41J 2/17566; B41J 2/175; B41J 2/17513; B41J 2/17596
See application file for complete search history.

(56) References Cited

U.S. PATENT DOCUMENTS 5,745,137 A * 4/1998 Scheffelin ..... B41J 2/175 347/50
6,386,693 B1 * 5/2002 Michele ..... B41J 2/17503 347/85

(Continued)

FOREIGN PATENT DOCUMENTS

JP 2002144598 5/2002
JP 2010094847 4/2010

OTHER PUBLICATIONS

'Everything You Need to Know About a Continuous Ink System (CISS)'; Inkexpress.co.uk, From the Internet (Nov. 24, 2015); URL: <http://www.inkexpress.co.uk/about-continuous-ink-systems-ciss.html>.

*Primary Examiner* — Jason S Uhlenhake
(74) *Attorney, Agent, or Firm* — Crawford Maunu PLLC

(57) ABSTRACT

One example of a system includes a bulk ink assembly, a printhead assembly, a valve, and a controller. The bulk ink assembly receives a bulk ink supply. The printhead assembly includes nozzles to eject ink drops, a collapsible container to supply ink to the nozzles, and a sensor to provide a sensor signal indicating the amount of ink within the collapsible container. The valve supplies ink to the collapsible container from the bulk ink assembly in response to a control signal. The controller provides the control signal based on the sensor signal to regulate the amount of ink in the collapsible container and to provide an out of ink signal based on the sensor signal indicating the bulk ink supply is effectively empty.

20 Claims, 6 Drawing Sheets

(52) U.S. Cl.
CPC .. *B41J 2/17596* (2013.01); *B41J 2002/17516* (2013.01); *B41J 2002/17579* (2013.01); *B41J 2002/17586* (2013.01)

(56) References Cited

U.S. PATENT DOCUMENTS

| | | | | |
|---|---|---|---|---|
| 2002/0145650 | A1* | 10/2002 | Pan | B41J 2/17509 347/85 |
| 2004/0252146 | A1 | 12/2004 | Naka et al. | |
| 2006/0007254 | A1 | 1/2006 | Tanno et al. | |
| 2006/0250425 | A1 | 11/2006 | Nambudiri et al. | |
| 2007/0008365 | A1 | 1/2007 | Lee et al. | |
| 2014/0240406 | A1 | 8/2014 | Lacaze et al. | |

* cited by examiner

PRINTHEAD ASSEMBLY

BACKGROUND

An inkjet printing system, as one example of a fluid ejection system, may include a printhead, an ink supply which supplies liquid ink to the printhead, and an electronic controller which controls the printhead. The printhead, as one example of a fluid ejection device, ejects drops of ink through a plurality of nozzles or orifices and toward a print medium, such as a sheet of paper, so as to print onto the print medium. In some examples, the orifices are arranged in at least one column or array such that properly sequenced ejection of ink from the orifices causes characters or other images to be printed upon the print medium as the printhead and the print medium are moved relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Figure 1:
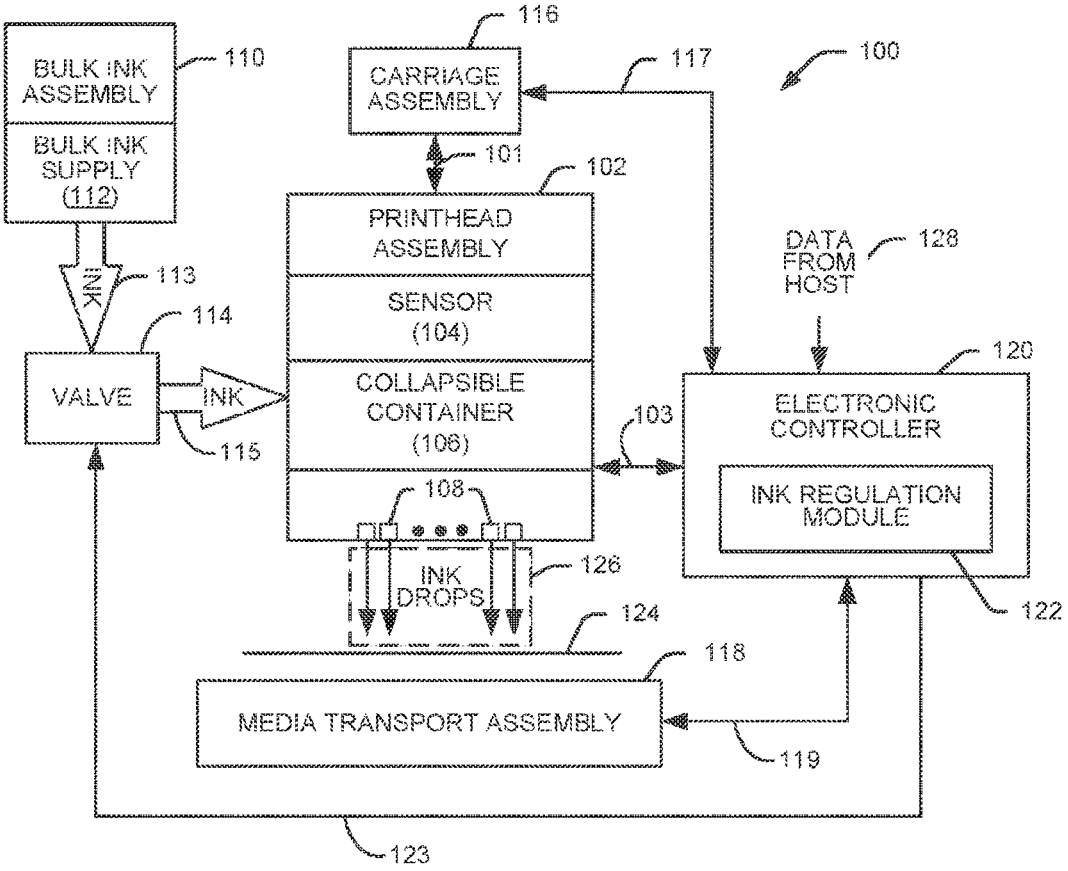
FIG. 1 is a block diagram illustrating one example of an inkjet printing system.

FIG. 1 is a block diagram illustrating one example of an inkjet printing system 100. Inkjet printing system 100 includes a fluid ejection assembly, such as printhead assembly 102, and a fluid supply assembly, such as bulk ink assembly 110. In the illustrated example, inkjet printing system 100 also includes a valve 114, a carriage assembly 116, a print media transport assembly 118, and an electronic controller 120. While the following description provides examples of systems and assemblies for fluid handling with regard to ink, the disclosed systems and assemblies are also applicable to the handling of fluids other than ink, including other liquids and/or toners and 3D powders.

Printhead assembly 102 includes at least one printhead or fluid ejection device which ejects drops of ink or fluid through a plurality of orifices or nozzles 108. In one example, the drops are directed toward a medium, such as print media 124, so as to print onto print media 124. Print medium 124 includes any type of suitable sheet material, such as paper, card stock, transparencies, Mylar, fabric, and the like. In one example, nozzles 108 are arranged in at least one column or array such that properly sequenced ejection of ink from nozzles 108 causes characters, symbols, and/or other graphics or images to be printed upon print media 124 as printhead assembly 102 and print media 124 are moved relative to each other. Printhead assembly 102 also includes a sensor 104 and a collapsible container 106. Collapsible container 106 supplies ink to nozzles 108. Sensor 104 senses the amount of ink within collapsible container 106. In one example, printhead assembly 102 including sensor 104, collapsible container 106, and nozzles 108 are housed together in an inkjet or fluid-jet print cartridge or pen.

Bulk ink assembly 110 supplies ink to collapsible container 106 of printhead assembly 102 and includes a bulk ink supply 112 for storing ink. Bulk ink assembly 110 is separate from printhead assembly 102 and supplies ink to printhead assembly 102 through a first interface connection 113, such as a supply tube, valve 114, and a second interface connection 115, such as another supply tube.

Carriage assembly 116 positions printhead assembly 102 relative to print media transport assembly 118 and print media transport assembly 118 positions print media 124 relative to printhead assembly 102. Thus, a print zone 126 is defined adjacent to nozzles 108 in an area between printhead assembly 102 and print media 124. In one example, printhead assembly 102 is a scanning type printhead assembly such that carriage assembly 116 moves printhead assembly 102 relative to print media transport assembly 118. In another example, printhead assembly 102 is a non-scanning type printhead assembly such that carriage assembly 116 fixes printhead assembly 102 at a prescribed position relative to print media transport assembly 124.

Electronic controller 120 communicates with printhead assembly 102 through a communication path 103, carriage assembly 116 through a communication path 117, print media transport assembly 118 through a communication path 119, and valve 114 through a communication path 123. In one example, when printhead assembly 102 is mounted in carriage assembly 116, electronic controller 120 and printhead assembly 102 may communicate via carriage assembly 116 through a communication path 101. Electronic controller 120 may also communicate with bulk ink assembly 110 such that, in one implementation, a new (or used) ink supply may be detected.

Electronic controller 120 receives data 128 from a host system, such as a computer, and may include memory for temporarily storing data 128. Data 128 may be sent to inkjet printing system 100 along an electronic, infrared, optical or other information transfer path. Data 128 represent, for example, a document and/or file to be printed. As such, data 128 form a print job for inkjet printing system 100 and includes at least one print job command and/or command parameter.

In one example, electronic controller 120 provides control of printhead assembly 102 including timing control for ejection of ink drops from nozzles 108. As such electronic controller 120 defines a pattern of ejected ink drops which form characters, symbols, and/or other graphics or images on print media 124. Timing control and, therefore, the pattern of ejected ink drops, is determined by the print job commands and/or command parameters. In one example, logic and drive circuitry forming a portion of electronic controller 120 is located on printhead assembly 102. In another example, logic and drive circuitry forming a portion of electronic controller 120 is located off printhead assembly 102.

Electronic controller 120 includes an ink regulation module 122. Ink regulation module 122 receives the sensor signal from sensor 104 of printhead assembly 102. Ink regulation module 122 regulates the amount of ink within collapsible container 106 and provides an out of ink signal based on the sensor signal. Based on the sensor signal, ink regulation module 122 provides a control signal to valve 114 to open and/or close valve 114 to selectively transfer ink from bulk ink supply 112 to collapsible container 106 to regulate the amount of ink within collapsible container 106.

When bulk ink supply 112 is effectively empty (i.e., for a given ink extraction process the ink flow rate slows greatly, e.g., less than 20% of the full flow rate), the refill rate of collapsible container 106 when valve 114 is open will decrease. This decrease in the refill rate of collapsible container 106 is detected by ink regulation module 122 based on the sensor signal. In response to detecting a decrease in the refill rate, ink regulation module 122 generates an out of ink signal indicating bulk ink supply 112 is effectively empty. In response to the out of ink signal, a user of inkjet printing system 100 may be prompted to replace or refill bulk ink supply 112. Printhead assembly 102 may continue printing after the out of ink signal is generated until the sensor signal indicates that collapsible container 106 is also effectively empty.

Figure 2:
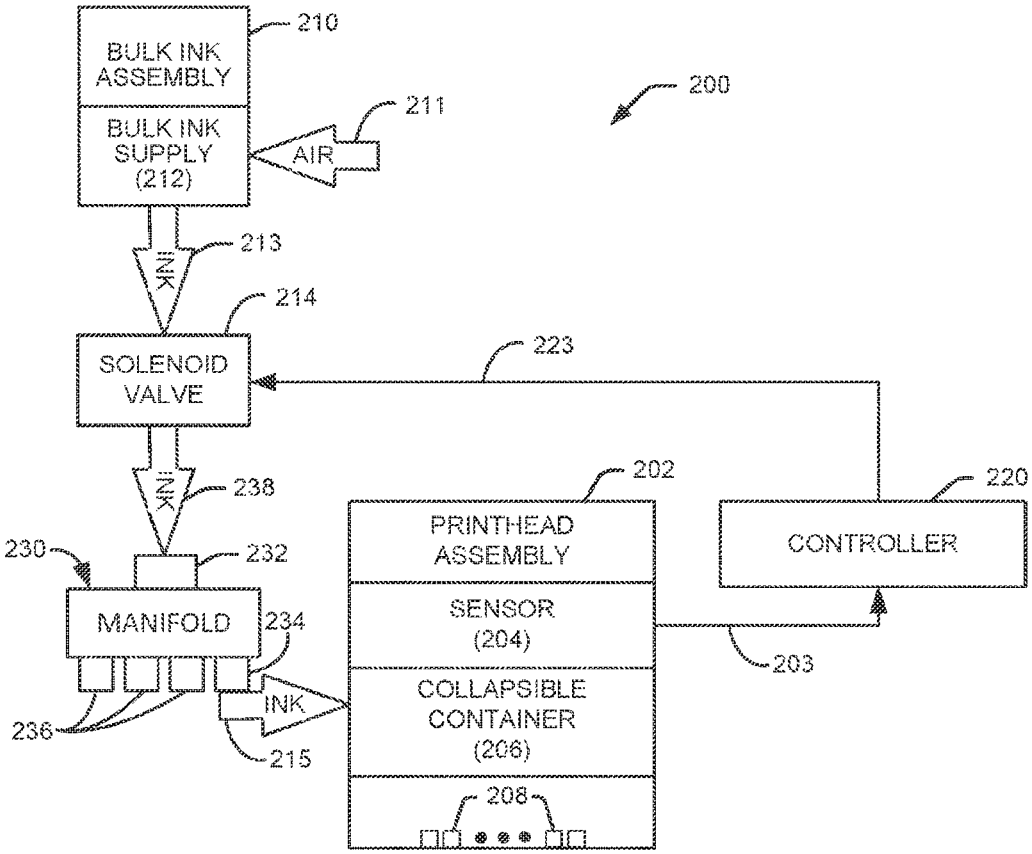
FIG. 2 is a block diagram illustrating one example of an ink regulation and out of ink signal generation system.

FIG. 2 is a block diagram illustrating one example of an ink regulation and out of ink signal generation system 200. System 200 includes a printhead assembly 202, a bulk ink assembly 210, a solenoid valve 214, a controller 220, and a manifold 230. Printhead assembly 202 includes a sensor 204, a collapsible container 206, and nozzles 208. Collapsible container 206 supplies ink to nozzles 208. Sensor 204 senses the amount of ink within collapsible container 206. In one example, printhead assembly 202 including sensor 204, collapsible container 206, and nozzles 208 are housed together in an inkjet or fluid-jet print cartridge or pen.

Bulk ink assembly 210 supplies ink to collapsible container 206 of printhead assembly 202 and includes a bulk ink supply 212 for storing ink. Bulk ink assembly 210 is separate from printhead assembly 202 and supplies ink to printhead assembly 202 through a first interface connection 213, solenoid valve 214, a second interface connection 238, manifold 230, and a third interface connection 215. Interface connections 213, 238, and 215 may be supply tubes. Manifold 230 includes an input port 232 connected to second interface connection 238, a first output port 234 connected to third interface connection 215, and a plurality of other output ports 236, which may supply ink to other printhead assemblies (not shown) from bulk ink assembly 210. In one example, bulk ink supply 212 may be pressurized (e.g., 4-6 PSI) by air received through an interface connection 211 to force ink into collapsible container 206 when solenoid valve 214 is open. In other examples, ink from bulk ink supply 212 may be gravity fed into collapsible container 206 when solenoid valve 214 is open.

Controller 220 receives a sensor signal from sensor 204 through a communication path 203 and provides a control signal to solenoid valve 214 through a communication path 223. In one example, controller 220 is a separate controller from an electronic controller used to control the other functions of a printing system in which printhead assembly 202 is installed. Controller 220 regulates the amount of ink within collapsible container 206 and provides an out of ink signal based on the sensor signal. Based on the sensor signal, controller 220 provides a control signal to solenoid valve 214 to open and/or close valve 214 to selectively transfer ink from bulk ink supply 212 to collapsible container 206 to regulate the amount of ink within collapsible container 206.

When bulk ink supply 212 is effectively empty (i.e., for a given ink extraction process the ink flow rate slows greatly, e.g., less than 20% of the full flow rate), the refill rate of collapsible container 206 when solenoid valve 214 is open will decrease. This decrease in the refill rate of collapsible container 206 is detected by controller 220 based on the sensor signal. In response to detecting a decrease in the refill rate, controller 220 generates an out of ink signal indicating bulk ink supply 212 is effectively empty. In response to the out of ink signal, a user of system 200 may be prompted to replace or refill bulk ink supply 212. Printhead assembly 202 may continue printing after the cut of ink signal is generated until the sensor signal indicates that collapsible container 206 is also effectively empty.

Figure 3A:
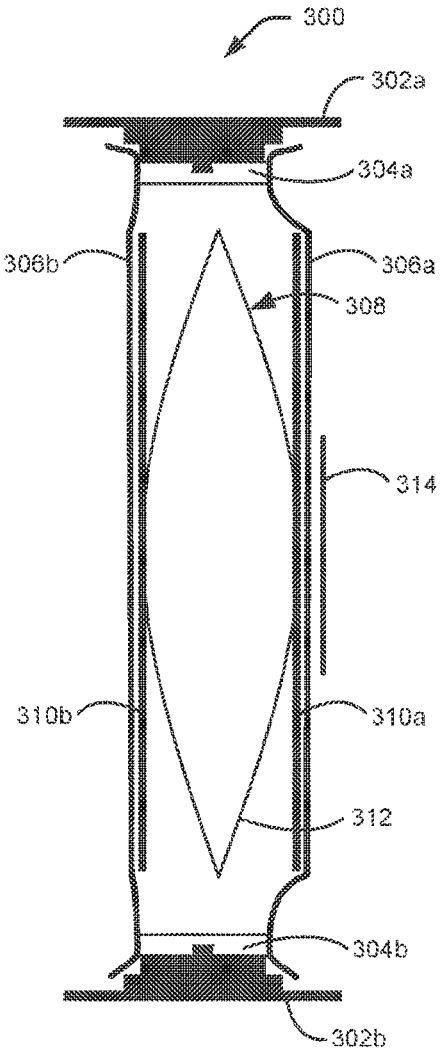
FIG. 3A illustrates one example of a collapsible container in an expanded state and FIG. 3B illustrates one example the collapsible container in a collapsed state.
Figure 3B:
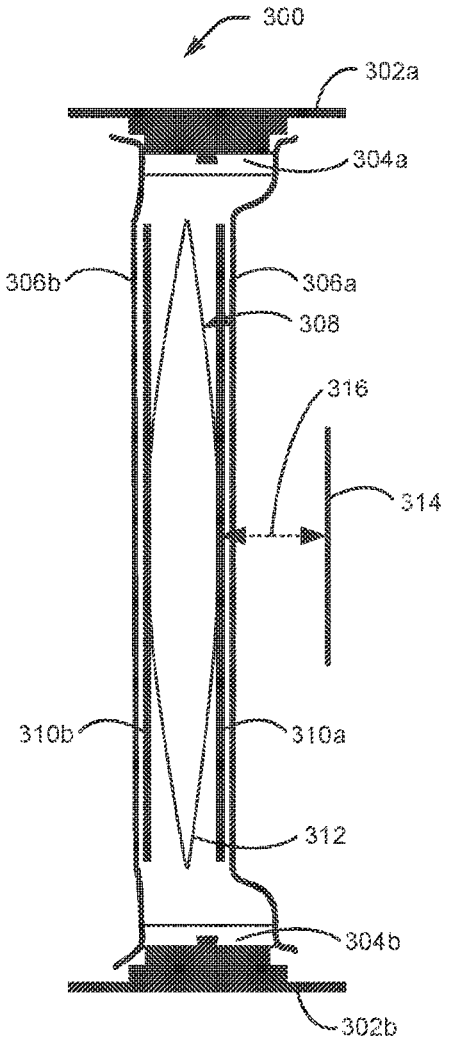

FIG. 3A illustrates one example of a collapsible container 300 in an expanded state and FIG. 3B illustrates one example of collapsible container 300 in a collapsed state. Collapsible container 300 may provide collapsible container 206 previously described and illustrated with reference to FIG. 2. In one example, collapsible container 300 is a spring bag. Collapsible container 300 includes a top housing portion 302*a*, a bottom housing portion 302*b*, a first flexible sidewall 306*a*, a second flexible sidewall 306*b*, and a spring assembly 308 between the first flexible sidewall 306*a* and the second flexible sidewall 306*b*. Spring assembly 308 includes a first plate 310*a* coupled to a second plate 310*b* via a leaf spring 312.

The top side of each flexible sidewall 306*a* and 306*b* is attached to top housing portion 302*a* via a connector 304*a*. The bottom side of each flexible sidewall 306*a* and 306*b* is attached to bottom housing portion 302*b* via a connector 304*b*. Flexible sidewalls 306*a* and 306*b* may comprise biaxially-oriented polyethylene terephthalate (BoPET) or another suitable material. Spring assembly 308 exerts constant pressure against flexible sidewalls 306*a* and 306*b* to expand. When ink is removed from collapsible container 300, flexible sidewalls 306*a* and 306*b* squeeze together as illustrated in FIG. 3B. When ink is added to collapsible container 300, flexible sidewalls 306*a* and 306*b* move further apart as illustrated in FIG. 3A. Spring assembly 308 maintains a sufficient back pressure within collapsible container 300 for proper ejection of ink from the nozzles of the printhead assembly.

In one example, second flexible sidewall 306*b* is constrained to limit the movement of second flexible sidewall 306*b* and first flexible sidewall 306*a* is not constrained. Second flexible sidewall 306*b* may be constrained by attaching second flexible sidewall 306*b* between top housing portion 302*a* and bottom housing portion 302*b* tightly such that second flexible sidewall 306*b* includes little or no excess material between top housing portion 302*a* and bottom housing portion 302*b*. First flexible sidewall 306*a* may be attached between top housing portion 302*a* and bottom housing portion 302*b* loosely such that first flexible sidewall 306*a* includes excess material between top housing portion 302*a* and bottom housing portion 302*b*. Accordingly, first flexible sidewall 306*a* moves to a much greater extent than second flexible sidewall 306*b* when ink is added and/or removed from collapsible container 300.

A sensor 314 attached to a sidewall of the housing (not shown) is arranged to sense the position of first plate 310*a* of spring assembly 308 relative to sensor 314. Sensor 314 provides a signal indicating the distance 316 (FIG. 3B) between sensor 314 and first plate 310*a*. In one example, sensor 314 may include a resonant circuit including an inductive coil for sensing the position of first plate 310*a* relative to sensor 314. In other examples, sensor 314 may include other suitable components for sensing the distance between first plate 310*a* and sensor 314. The sensor signal may be received by a controller, such as controller 220 previously described and illustrated with reference to FIG. 2, to determine the amount of ink within collapsible container 300, to regulate the amount of ink supplied to collapsible container 300 from a bulk ink supply, and to determine when the bulk ink supply is effectively empty.

Figure 4:
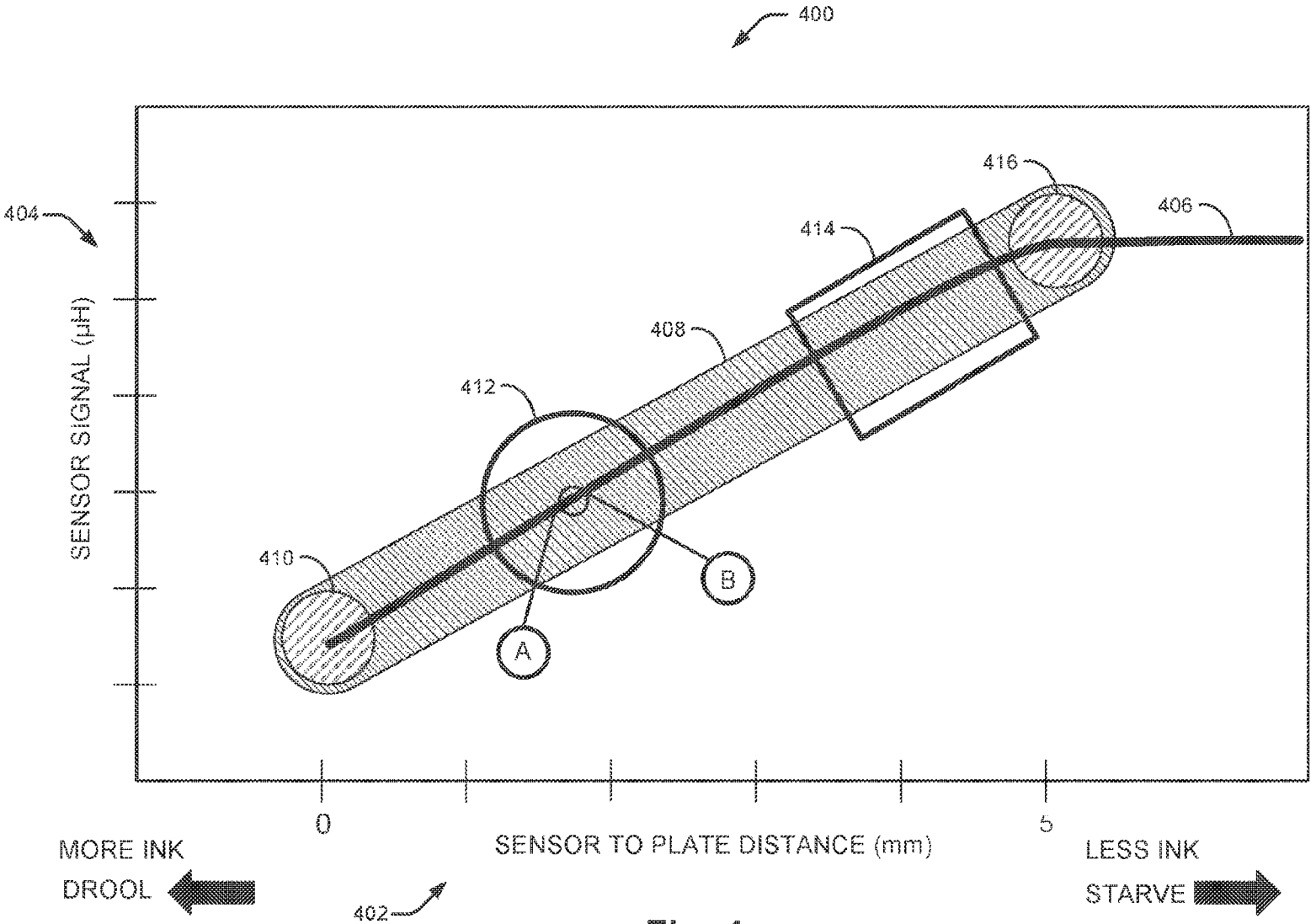
FIG. 4 is a chart illustrating one example of a sensor signal.

FIG. 4 is a chart 400 illustrating one example of a sensor signal 406. Sensor signal 406 may be received from sensor 314 previously described and illustrated with reference to FIGS. 3A and 3B. Chart 400 includes the sensor to plate distance in millimeters (mm) on x-axis 402 and the sensor signal in microHenry (μH) on y-axis 404. The amount of ink within the collapsible container may be determined by sensor signal 406 and is indicated at 408. While chart 400 illustrates a sensor to plate distance having a range between 0 mm and 5 mm, in other examples, the range of the sensor to plate distance may vary depending on the dimensions of the collapsible container and the position of the sensor relative to the collapsible container.

For a sensor to plate distance of about 0 mm as indicated at 410, the collapsible container is full. Excess pressure or ink within the collapsible container may result in ink drool through the nozzles of the printhead assembly. For a sensor to plate distance of about 5 mm as indicated at 416, the collapsible container is effectively empty and the nozzles of the printhead assembly may be starved for ink. An ink fill target is indicated at 414 for a sensor to a plate distance between about 4 mm and 5 mm. The ink fill target may be the amount of ink within a collapsible container prior to use within a printing system (e.g., for shipping).

In this example, a regulation zone is indicated at 412 at a sensor to plate distance of around 2 mm. The regulation zone defines ink volume thresholds between which the controller should maintain the volume of ink within the collapsible container by periodically refilling the collapsible container from a bulk ink supply. A first threshold (i.e., a shorter sensor to plate distance) is indicated at (A) and a second threshold (i.e., a longer sensor to plate distance than the first threshold) is indicated at (B). In one example, the difference in the volume of ink within the collapsible container between threshold (A) and threshold (B) is approximately 0.6 milliliters.

Figure 5A:
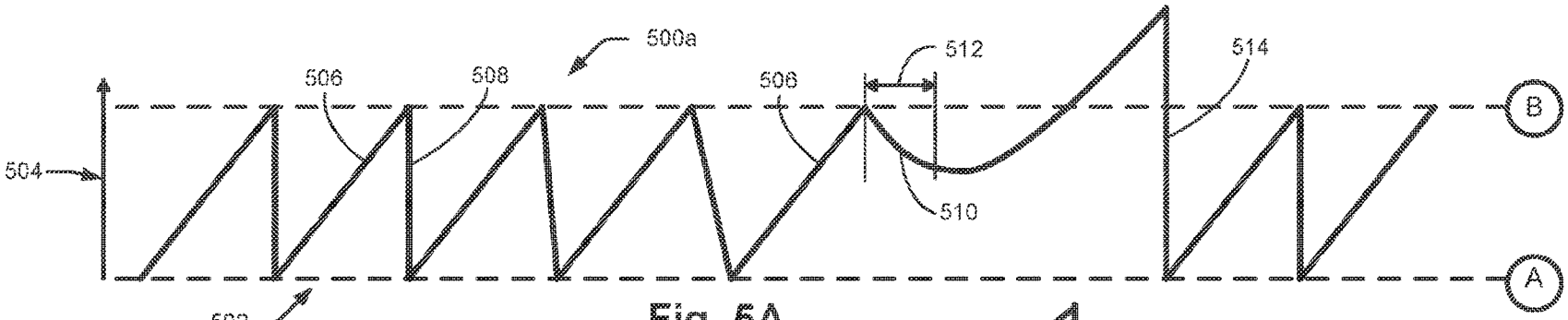
FIGS. 5A-5C are charts illustrating example sensor signals for example regulation and out of ink signal generation processes.
Figure 5B:
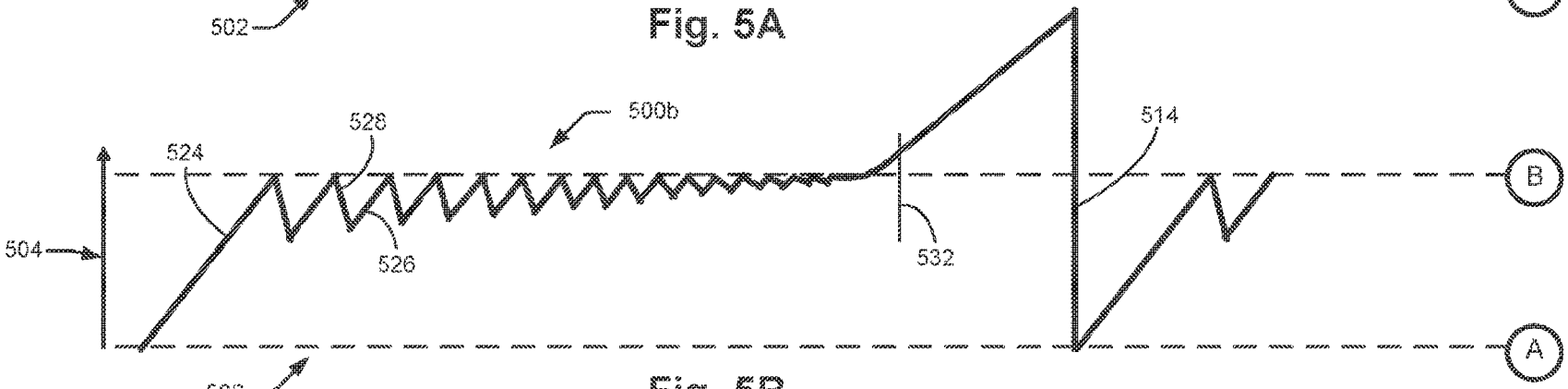
Figure 5C:
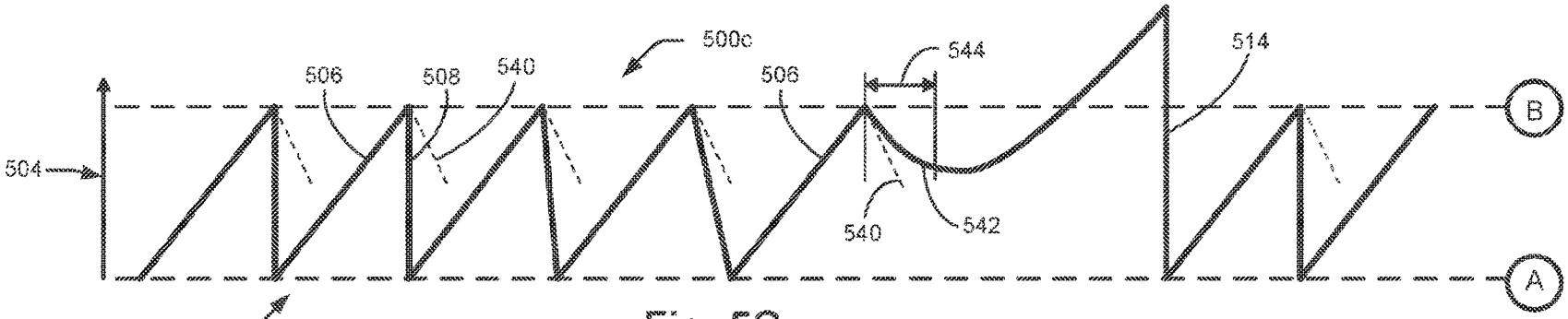

FIGS. 5A-5C are charts illustrating example sensor signals for example regulation and out of ink signal generation processes. FIG. 5A is a chart 500*a* illustrating bang-bang regulation. Chart 500*a* includes time on x-axis 502 and the sensor signal on y-axis 504. In bang-bang regulation, the controller maintains the amount of ink within the collapsible container between thresholds (A) and (B). As the printhead assembly ejects ink, the sensor signal moves from threshold (A) to threshold (B) as indicated at 506. Once the sensor signal reaches threshold (B) or crosses threshold (B), the controller provides the control signal to open the valve to refill the collapsible container as indicated at 508. Once the sensor signal reaches threshold (A) or crosses threshold (A), the controller provides the control signal to close the valve to stop the refill of the collapsible container.

As the bulk ink supply empties, the refill time to refill the collapsible container increases. Accordingly, as indicated at 510. Once the bulk ink supply is effectively empty, the refill time will exceed a selected period indicated at 512 and the volume of ink within the collapsible container will not reach threshold (A) or cross threshold (A) within the selected period. The selected period may be a predetermined period (e.g., 10 seconds) or may be determined by the controller. For example, the controller may monitor the refill time at 508 and set the selected period to be greater than the monitored refill time. Once threshold (A) is not reached or crossed within the selected period from opening of the valve, the controller provides the out of ink signal indicating the bulk ink supply is effectively empty. When the out of ink signal is provided, the controller also closes the valve until the bulk ink supply is replenished. Once the bulk ink supply is replenished, the controller opens the valve to refill the collapsible container as indicated at 514 and the ink regulation resumes.

FIG. 5B is a chart 500*b* illustrating pulse regulation. Chart 500*b* includes time on x-axis 502 and the sensor signal on y-axis 504. In pulse regulation, the controller maintains the amount of ink within the collapsible container between thresholds (A) and (B). As the printhead assembly ejects ink, the sensor signal moves from threshold (A) to threshold (B) as indicated at 524. Each time the sensor signal reaches threshold (B) or crosses threshold (B) or is above threshold (B), the controller provides the control signal to open the valve to refill the collapsible container as indicated at 528. Once a selected period elapses, the valve is closed to stop the refill of the collapsible container. As the printhead assembly continues to eject ink, the sensor signal moves toward threshold (B) as indicated at 526. The selected period may be a predetermined period (e.g., 100 milliseconds) or may be determined by the controller. For example, the controller may monitor the refill time at 528 and set the selected period to maintain the regulation between thresholds (A) and (B).

As the bulk ink supply empties, the refill time to refill the collapsible container increases. Accordingly, as indicated at 532, once the bulk ink supply is effectively empty, the refill time will exceed the selected period and the volume of ink within the collapsible container will not cross threshold (B) toward threshold (A) within the selected period from the opening of the valve. In one example, once threshold (B) is not crossed within the selected period from opening of the valve, the controller provides the out of ink signal indicating the bulk ink supply is effectively empty. In another example, the controller provides the out of ink signal in response to the sensor signal not crossing threshold (B) within a selected number of valve open and close cycles (e.g., 3 cycles). In another example, the controller provides the out ink signal in response to the refill rate failing below a selected refill rate. When the cut of ink signal is provided, the controller leaves the valve closed until the bulk ink supply is replenished. Once the bulk ink supply is replenished, the controller opens the valve to refill the collapsible container as indicated at 514 and the ink regulation resumes.

FIG. 5C is a chart 500*c* illustrating refill rate regulation. Chart 500*c* includes time on x-axis 502 and the sensor signal on y-axis 504. In refill rate regulation, the controller maintains the amount of ink within the collapsible container between thresholds (A) and (B). As the printhead assembly ejects ink, the sensor signal moves from threshold (A) to threshold (B) as indicated at 506. Once the sensor signal reaches threshold (B) or crosses threshold (B), the controller provides the control signal to open the valve to refill the collapsible container as indicated at 508. Once the sensor signal reaches threshold (A) or crosses threshold (A), the controller provides the control signal to close the valve to stop the refill of the collapsible container.

As the bulk ink supply empties, the refill time to refill the collapsible container increases. Accordingly, as indicated at 542, once the bulk ink supply is effectively empty, the refill rate will fall below a selected refill rate as indicated at 540. The selected refill rate may be a predetermined rate or may be determined by the controller. For example, the controller may monitor the refill rate at 508 and set the selected refill rate to be less than the monitored refill rate. The refill rate may be determined over a selected period indicated at 544. The selected period may be a predetermined period (e.g., 10 seconds) or may be determined by the controller. For example, the controller may monitor the refill time at 508 and set the selected period to be greater than the monitored refill time. Once the sensed refill rate falls below the selected refill rate, the controller provides the out of ink signal indicating the bulk ink supply is effectively empty. When the out of ink signal is provided, the controller also closes the valve until the bulk ink supply is replenished. Once the bulk ink supply is replenished, the controller opens the valve to refill the collapsible container as indicated at 514 and the ink regulation resumes.

Figure 6:
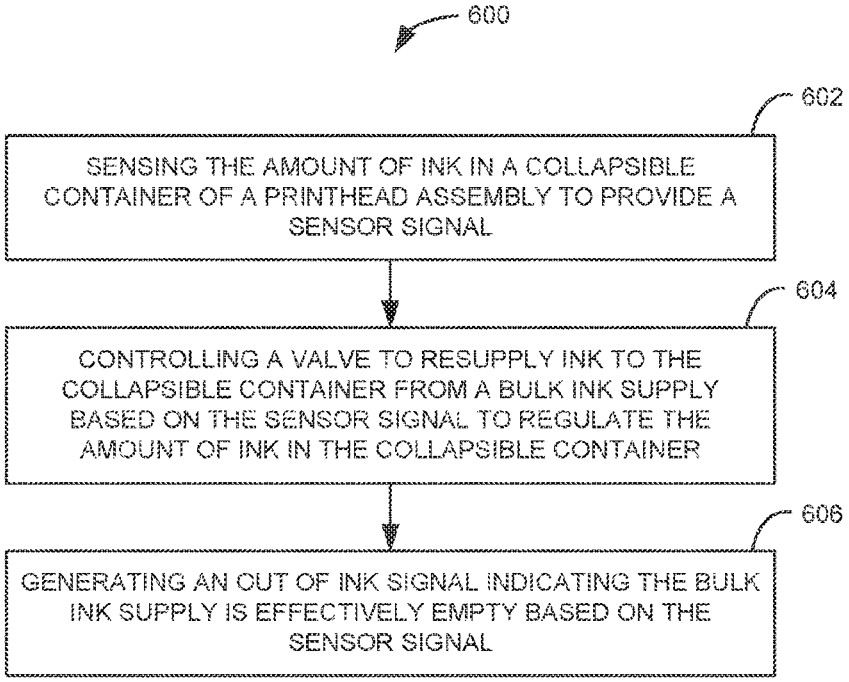
FIG. 6 is a flow diagram illustrating one example of a method for regulating ink and providing an out of ink signal.

FIG. 6 is a flow diagram illustrating one example of a method 600 for regulating ink and providing an out of ink signal. At 602, the method includes sensing the amount of ink in a collapsible container of a printhead assembly to provide a sensor signal. In one example, sensing the amount of ink in the collapsible container comprises inductively sensing the distance between a plate of the collapsible container and a sidewall of the printhead assembly. At 604, the method includes controlling a valve to resupply ink to the collapsible container from a bulk ink supply based on the sensor signal to regulate the amount of ink in the collapsible container. At 606, the method includes generating an out of ink signal indicating the bulk ink supply is effectively empty based on the sensor signal.

In one example, controlling the valve comprises opening the valve in response to the sensor signal reaching a first threshold and closing the valve in response to the sensor signal reaching a second threshold. Generating the out of ink signal may comprise generating the out of ink signal in response to the sensor signal failing to reach the second threshold within a selected period from the opening of the valve. In another example, generating the out of ink signal may comprise generating the out of ink signal in response to an ink resupply rate falling below a selected rate.

In another example, controlling the valve comprises opening the valve in response to the sensor signal crossing a threshold from a first side to a second side of the threshold and closing the valve in response to a selected period elapsing from the opening of the valve. Generating the out of ink signal may comprise generating the out of ink signal in response to the sensor signal remaining on the second side of the threshold after the selected period elapses. In another example, generating the out of ink signal may comprise generating the out of ink signal in response to the sensor signal remaining on the second side of the threshold for a selected number of valve open and close cycles.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A system comprising:

a bulk ink assembly to receive a bulk ink supply;

a printhead assembly including nozzles to eject ink drops, a collapsible container to supply ink to the nozzles, and a sensor to provide a sensor signal indicating an amount of ink within the collapsible container;

a valve to supply ink to the collapsible container from the bulk ink assembly in response to a control signal; and a controller to provide the control signal based on the sensor signal, to regulate the amount of ink in the collapsible container, and to provide an out of ink signal based on the sensor signal indicating the bulk ink supply is effectively empty.

2. The system of claim 1, wherein the controller is to provide the control signal and the out of ink signal in response to the sensor signal provided from the sensor, the sensor is to sense the amount of ink within the collapsible container, and the controller is further to:

provide the control signal to open the valve in response to the sensor signal reaching a first threshold and to close the valve in response to the sensor signal reaching a second threshold to regulate the amount of ink in the collapsible container, and provide the out of ink signal in response to the sensor signal not reaching the second threshold within a selected period from reaching the first threshold.

3. The system of claim 1, wherein the controller provides the control signal to open the valve in response to the sensor signal reaching a first threshold to resupply ink to the collapsible container and to close the valve in response to the sensor signal reaching a second threshold, and wherein the controller provides the out of ink signal in response to an ink resupply rate falling below a selected rate.

4. The system of claim 1, wherein the controller provides the control signal to open the valve in response to the sensor signal crossing a threshold from a first side to a second side of the threshold and to close the valve in response to a selected period elapsing from the opening of the valve, and wherein the controller provides the out of ink signal in response to the sensor signal not crossing the threshold from the second side to the first side within the selected period.

5. The system of claim 1, wherein the controller provides the control signal to open the valve in response to the sensor signal being on a first side of a threshold and to close the valve in response to a selected period elapsing from the opening of the valve, and wherein the controller provides the out of ink signal in response to the sensor signal not crossing from the first side of the threshold to a second side of the threshold within a selected number of valve open and close cycles.

6. The system of claim 1, wherein the printhead assembly is one of a plurality of printhead assemblies including nozzles to eject ink drops, and further comprising:

a manifold between the bulk ink assembly and the valve, the manifold to supply ink from the bulk ink assembly to the plurality of printhead assemblies.

7. The system of claim 1, wherein the bulk ink assembly includes a container with bulk ink, the controller includes circuitry to provide the control signal in response to the sensor signal provided by the sensor, and the valve is to supply ink to the collapsible container in response to the control signal from the controller.

8. The system of claim 1, wherein the collapsible container includes a top housing portion, a bottom housing portion, a first flexible sidewall and a second flexible sidewall and a spring assembly between the first flexible sidewall and the second flexible sidewall to exert force against the first flexible sidewall and the second flexible sidewall.

9. The system of claim 1, wherein the controller is to provide the control signal to open the valve in response to the sensor signal reaching a first threshold and to close the valve in response to the sensor signal reaching a second threshold to maintain an ink fill target within the collapsible container, and wherein the controller is to provide the out of ink signal in response to the sensor signal reaching the second threshold outside a selected period from reaching the first threshold.

10. The system of claim 1, wherein the controller is to provide the out of ink signal in response to the sensor signal indicating an ink fill target is unreached within a selected period of time, and in response to the out of ink signal, the print assembly including the nozzles is to continue to eject ink drops until the sensor signal indicates the collapsible container is effectively empty.

11. The system of claim 1, wherein the controller is to provide the control signal and the out of ink signal in response to the sensor signal provided from the sensor, the sensor is to sense the amount of ink within the collapsible container.

12. A printhead assembly comprising:

nozzles to eject ink drops;

a collapsible container to supply ink to the nozzles; and a sensor to provide a sensor signal indicating an amount of ink sensed within the collapsible container, wherein the sensor signal is to provide to an electronic controller that controls resupply of ink to the collapsible container from a bulk ink supply in response to the sensor signal provided from the sensor to regulate the amount of ink in the collapsible container and, the electronic controller is provide an out of ink signal indicating the bulk ink supply is effectively empty in response to the sensor signal provided from the sensor indicating an ink resupply time above a threshold.

13. The printhead assembly of claim 12, wherein the collapsible container comprises a spring bag, and wherein the sensor comprises an inductive coil to sense a position of a plate of the spring bag relative to the inductive coil of the collapsible container.

14. The printhead assembly of claim 13, wherein motion of a first sidewall of the spring bag is constrained and motion of a second sidewall of the spring bag opposite to the first sidewall is not constrained.

15. The printhead assembly of claim 12, wherein the controller controls the resupply of ink to the collapsible container via a solenoid valve connected between the collapsible container and the bulk ink supply, and the signal sensor that causes the control signal and the out of ink signal is from the same sensor.

16. A method comprising:

sensing an amount of ink in a collapsible container of a printhead assembly that includes nozzles to eject ink drops and a sensor to provide a sensor signal indicative of the amount of ink sensed in the collapsible container;

to regulate the amount of ink in the collapsible container, controlling a valve to resupply ink to the collapsible container from a bulk ink supply in response to the sensor signal provided from the sensor; and generating an out of ink signal for the bulk ink supply in response to the sensor signal provided from the sensor.

17. The method of claim 16, wherein controlling the valve comprises opening the valve in response to the sensor signal reaching a first threshold and closing the valve in response to the sensor signal reaching a second threshold, and wherein generating the out of ink signal comprises generating the out of ink signal in response to the sensor signal failing to reach the second threshold within a selected period from the opening of the valve.

18. The method of claim 16, wherein controlling the valve comprises opening the valve in response to the sensor signal reaching a first threshold and closing the valve in response to the sensor signal reaching a second threshold, and wherein generating the out of ink signal comprises determining an ink resupply rate based on the sensor signal provided from the sensor, and generating the out of ink signal in response to the ink resupply rate falling below a selected rate.

19. The method of claim 16, wherein controlling the valve comprises opening the valve in response to the sensor signal crossing a threshold from a first side to a second side of the threshold and closing the valve in response to a selected period elapsing from the opening of the valve, and wherein generating the out of ink signal comprises generating the out of ink signal in response to the sensor signal remaining on the second side of the threshold after the selected period elapses.

20. The method of claim 16, wherein sensing the amount of ink in the collapsible container comprises inductively sensing a distance between a plate of the collapsible container and a sidewall of the printhead assembly by the sensor.

* * * * *